US007316881B2

(12) United States Patent
Rimai et al.

(10) Patent No.: US 7,316,881 B2
(45) Date of Patent: Jan. 8, 2008

(54) METHOD OF PRODUCING A CUSTOM COLOR TONER

(75) Inventors: Donald S. Rimai, Webster, NY (US); William K. Goebel, Springwater, NY (US); Matthew C. Ezenyilimba, Walworth, NY (US); Peter S. Alexandrovich, Rochester, NY (US); Dinesh Tyagi, Fairport, NY (US); James H. Anderson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 614 days.

(21) Appl. No.: 10/973,042

(22) Filed: Oct. 25, 2004

(65) Prior Publication Data

US 2005/0095521 A1 May 5, 2005

Related U.S. Application Data

(60) Provisional application No. 60/515,623, filed on Oct. 30, 2003.

(51) Int. Cl.
*G03G 9/08* (2006.01)

(52) U.S. Cl. ..... 430/108.7; 430/137.1

(58) Field of Classification Search ..... 430/108.7, 430/137.1

See application file for complete search history.

(56) References Cited

U.S. PATENT DOCUMENTS

| | | | | |
|---|---|---|---|---|
| 5,204,208 | A * | 4/1993 | Paine et al. | 430/137.12 |
| 6,312,861 | B1 * | 11/2001 | Ciccarelli et al. | 430/108.3 |
| 6,413,692 | B1 * | 7/2002 | Cheng | 430/137.14 |
| 2003/0215730 | A1 * | 11/2003 | Srinivasan et al. | 430/108.3 |

* cited by examiner

*Primary Examiner*—Hoa Van Le
(74) *Attorney, Agent, or Firm*—Carl F. Ruoff

(57) ABSTRACT

A method of producing a custom color particulate toner for use in a two-component developer by mixing two or more component color toners. The component color toners are each surface treated with a blend of two or more types of silica particles, which differ in the functional groups appended to them. The silica blend for each component color toner is chosen so that, when the component color toners are mixed together to form the custom color mixture, they will all tribocharge to the same charge-to-mass ratio when mixed with a carrier to form a developer.

27 Claims, 2 Drawing Sheets

METHOD OF PRODUCING A CUSTOM COLOR TONER

CROSS REFERENCE TO RELATED APPLICATION

Reference is made to and priority claimed from U.S. Provisional Application Ser. No. 60/515,623, filed on Oct. 30, 2003, entitled: A METHOD OF PRODUCING A CUSTOM COLOR TONER.

FIELD OF THE INVENTION

This invention relates to particulate toners for use in two-component developers and in particular to a method of producing a custom color toner.

BACKGROUND OF THE INVENTION

In electrophotographic reproduction apparatus and printers, an electrostatic latent image is formed on a photoconducting imaging member by first uniformly charging the imaging member and then image-wise exposing the imaging member using various devices such as a scanned laser, LED array, optical flash, or other suitable, known methods. The electrostatic latent image is then developed into a visible image by bringing the imaging member into close proximity with a developer that includes toner particles. In a 2-component developer, toner particles are mixed with larger, magnetic particles called carrier particles. The toner and carrier particles often contain charge agents that enable the toner particles to become triboelectrically charged by contact with the carrier particles. The developer is contained in a development station that typically includes a roller with a magnetic core, a sump that contains a quantity of developer, a device for determining the concentration of toner in the developer, and a mechanism for replenishing the toner when the toner concentration drops below a certain level. The carrier particles transport the toner into contact with the imaging member bearing the electrostatic latent image. The development station is suitably biased and the toner particles suitably charged so that the proper amount of toner particles is deposited in either the charged or discharged regions of the imaging member.

After the electrostatic latent image on the imaging member has been developed, the toned image is generally transferred to a receiver such as paper or transparency stock. This is generally accomplished by applying an electric field in such a manner to urge the toner from the imaging member to the receiver. In some instances, it is preferable to first transfer the toned image from the imaging member to an intermediate member and then from the intermediate member to the receiver. Again, this is most commonly accomplished by applying an electric field to urge the toned image towards the appropriate member.

The electrophotographic imaging process described above may be used to produce mono-color, typically black, or multi-color images. In so-called full-color or process-color imaging, toner pigmented with the subtractive primary colors, cyan, magenta, and yellow, are used along with black toner. Cyan, magenta, yellow, and black developed toner images are created separately by the above described process and transferred in register to the receiver. This process is typically used for pictorial imaging. A range or gamut of colors is produced by the varying amounts of the subtractive primary colored toners plus black in the image. Alternatively, it is sometimes desirable to employ a spot color or custom color toner in a single developer station to create a single colored image. Corporate logos and the like are such applications. Custom color toner may be produced by incorporating a custom color pigment into the toner during the toner manufacturing process. A disadvantage of producing a custom color toner in this way is that the amount of custom color toner needed for a given application may be less than the amount that is cost effective to manufacture in a production run. An alternative method of producing a custom color toner, which avoids the above mentioned disadvantage, is to create the custom color toner by blending together appropriate amounts of component toners pigmented during manufacture with the subtractive primary colored pigments, cyan, magenta, and yellow. If the desired custom color is not within the gamut of the cyan, magenta, and yellow component toners, additional colored component toners may be used in the blended custom color toner. This method is analogous to the mixing of component color paints to produce a custom color paint. However, this alternative method of producing a custom color toner also has a disadvantage, which is described below.

The rate at which toner is developed, from the development station, onto the electrostatic latent image is dependent on several parameters, including the toner charge, specifically the toner charge normalized to the mass of the toner particle and designated as charge-to-mass (q/m). As described above, the toner is charged by triboelectric interaction with the magnetic carrier particles. The toner charge is determined, in part, by the choice of charge agents incorporated into the toner. However, toner q/m may also depend on the toner particle size. Since the toner is charged through a triboelectric process, the more surface area available, the higher the value of q/m can be. Since smaller particles have higher surface area for a given mass than larger particles, q/m tends to increase as the size of the toner decreases. In addition, the different pigments used in the component toners also tend to have different triboelectric properties. This results in different component color toners potentially having different q/m ratios if mixed with the same carrier to form a developer. If the q/m of the component toners blended to make a custom color toner are significantly different, the components of the blended toner will develop the electrostatic latent image at different rates, thereby causing the color of the blended toner to vary with use.

SUMMARY OF THE INVENTION

In view of the above, it is the object of the present invention to provide different color component toners that, when blended together to form a custom color blended toner, tribocharge to the same q/m on a common carrier. The applicants have discovered that small particulate silica addenda, typically applied to the surface of the toner to improve toner flow and transferability, may also be used to adjust the triboelectric properties of the toner. Using this discovery, two or more different color component toners can be surface treated with predetermined amounts of appropriate particulate addenda so that, when the component toners are blended together to make a custom color toner, the component toners charge to the same q/m on a common carrier. As a result, during the development step in the electrophotographic imaging process, the component toners in the blended toner, develop onto the electrostatic latent image at the same rate. Therefore, the ratio of the blended components, and therefore the color of the blended custom color toner, remains constant with use.

The invention, and its objects and advantages, will become more apparent in the detailed description of the preferred embodiment presented below.

BRIEF DESCRIPTION OF THE DRAWINGS

The invention and its technical advantageous effects will be better appreciated from the ensuing detailed description of a preferred embodiment, reference being made to the accompanying drawings.

DETAILED DESCRIPTION OF THE INVENTION

Figure 1:
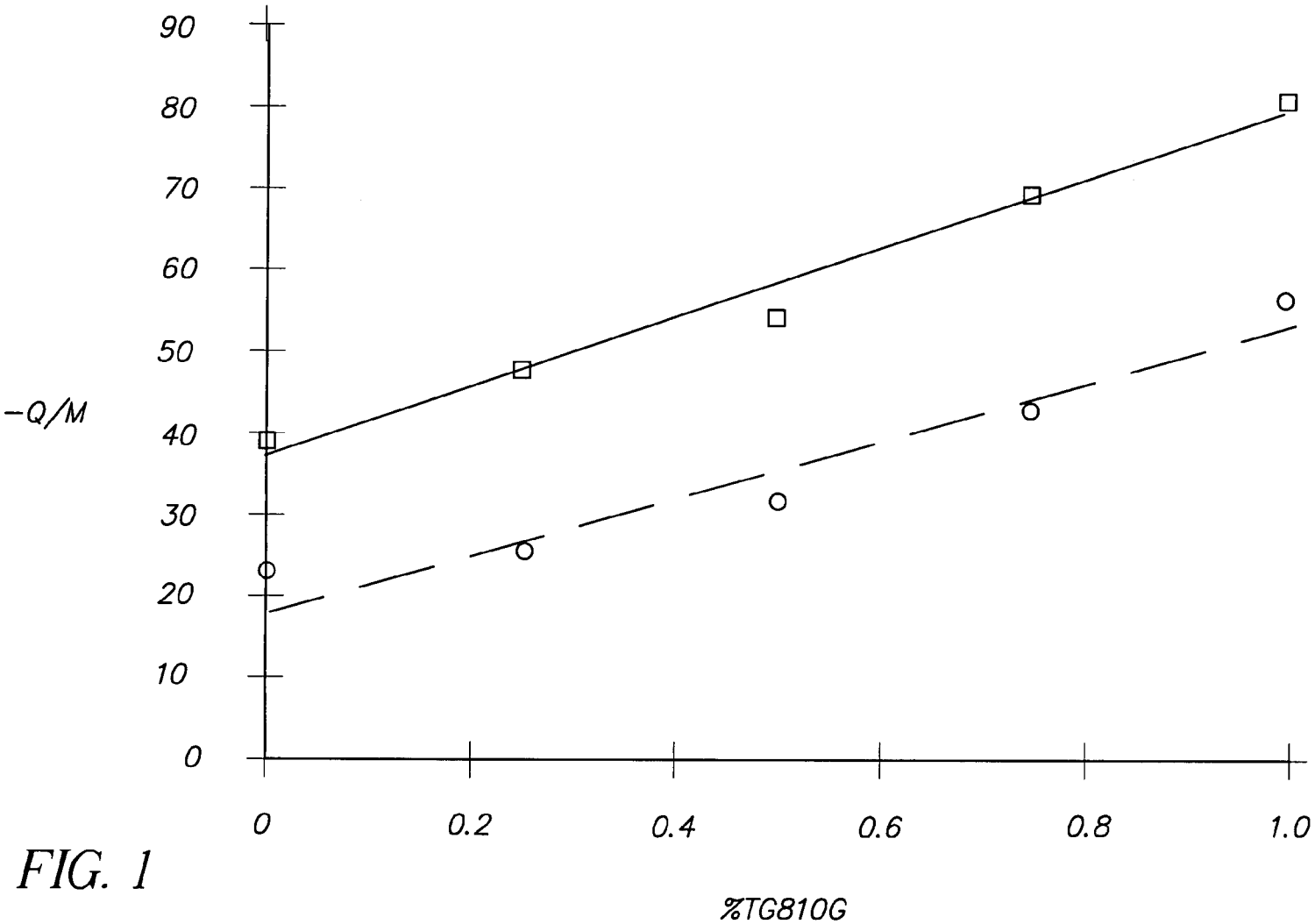
FIG. 1 is a plot of the q/m ratio of samples of two different component color toners versus the percent of one of the two silicas used to prepare the samples.

Toners for two component developers for use in electrophotographic imaging processes are typically made either by mechanical pulverization methods or by chemical methods such as limited coalescence, evaporative limited coalescence, emulsion polymerization, suspension polymerization, or other known chemical methods. Typically none of these methods produce perfectly mono-disperse sized toner particles, but rather toner particle size distributions. For the purpose of this disclosure the following definitions with respect to toner particle size distributions, as measured, for example with a Coulter Multisizer, are used:

Number Median, DN(50)—In the number distribution, the particle size at which half of the particles are larger and half are smaller.

Volume Median, DV(50)—In the volume distribution, the particle size at which half of the particles are larger and half are smaller.

Fineness Index—In the number distribution, the ratio of the Number Median to the particle size at which the sum of 16% of the particles, DN(16), on the fine side of the distribution, is reached.

Volume weighted average diameter—In the volume distribution, the average diameter of a spherical particle calculated by weighting the diameter of each particle by the volume of a sphere of equal mass and density and dividing by the total volume of the particles.

Number weighted average diameter—In the number distribution, the average diameter of a spherical particle calculated by weighting the diameter of each particle by the number of particles having that diameter and dividing by the total number of the particles.

Except where otherwise noted, the term "toner diameter" refers to the volume weighted average diameter.

The addition of small particulate addenda to the surface of toner particles to improve flow and transferability is well known. In addition, the use of several different types of particulate addenda such as silica and titanium dioxide is also well known. However, it has been discovered that combinations of two or more types of silica, differing in the functionality of groups appended to the surface of the silica, may be used to adjust q/m of the toner in 2-component electrophotographic developers. The present invention is to produce a set of component toners in which q/m is adjusted so that it is independent of the color of the component toners when the component toners are mixed with common magnetic carrier particles. The surface of at least one of the component toner particles are coated with between 0.75% and 5.0% silica using at least two types of silica particles that differ by the functional groups appended to the surface of the silica particles. The silica particles have average diameters, as measured by field emission scanning electron micrographs, of between 7 nm and 70 nm. Related art, referenced in this application, discloses the use of various types of addenda with blends of toners to create custom color toners, but none discloses the use of silicas, with different functional groups, on the separate colored toners to equalize the charge of those toners. Although the silica can be appended with many different functional groups, it is preferable to use silane based derivatives. Such derivatives include dimethyl-dichloro-silane, hexamethyl-disalazane, silicone oil, tri-methoxy-octyl-silane, octamethyl-cyclo-tetra-siloxane, hexadecyl-silane, triethoxy-proply-amino-silane, methy-acryl-silane, or the like. Appropriate silicas are commercially available.

It is most advantageous to use this invention with toners having diameters between 3.0 μm and 6.0 μm. The total quantity of silica is determined by factors such as toner flow, transferability, or various image quality metrics such as granularity. However, if the toner particle diameter exceeds approximately 9 μm, the amount of silica present after optimizing those parameters might be insufficient to allow a sufficient number of tribocharging sites to effectively control the charge. Conversely, if the toner particles are too small, for example, less than approximately 2 μm, it might be necessary to use so much silica so as to form large silica agglomerates (greater than 100 nm in diameter). This would limit the number of triboelectrically charging sites on the silica actually available to tribocharge. For most applications, it is only necessary to use two distinct functionally-treated silicas to gain the advantages of the present invention. In some applications, however, such as when it is desired to stabilize the charge of the developer with toner concentration variations or with variations in relative humidity, it may be desired to add additional distinct functionalized silicas. The specific choice of silica varies with the toners and carriers that are to be used in forming the electrophotographic developer.

Toners can be surface treated with two or more functionalized silicas using known methods. Such methods include physically blending the toner particles with the appropriate quantities of the chosen silicas. For small laboratory quantities, household blenders can be used. For large production quantities, high-energy stirring batch mixers such as those available from Thyssen-Henschel Corporation can be used. The advantages of this invention are limited to so-called dry, 2-component developers comprising toner and magnetic carrier particles. No advantage is foreseen for single component dry developers in which charging of the toner particles is accomplished by other means. Similarly, no advantage is seen for liquid based systems in which toner charging is generally accomplished by chemical means.

This invention is also most beneficial when practiced with toners that have a narrow size distribution because wide size distributions tend to broaden the distribution of charge of the toner. Such a broad charge distribution would tend to mask the benefits of this invention. Specifically, it is desirable that the fineness index be between 1.0 and 1.3. Such distributions are commonly obtained by making the toners by chemical means such as evaporative limited coalescence, suspension polymerization, limited coalescence, emulsion polymerization, and the like. The size distribution of toner may be narrowed by classification of the toner after it was made. Ground toners may benefit by this invention if the fineness index is less than 1.3. However, it is typical for most ground and well-classified toners to have fineness indexes between 1.4 and 1.5.

When practicing this invention, the q/m ratio may be determined by various known techniques, for example as described by Maher (IS&T's Tenth International Congress on Advances in Non-Impact Printing Technologies (1994), pp. 156-159). The specific method of determining the q/m ratio is not critical as long as that method can precisely and reproducibly determine the q/m ratio. It is recommended, however, that a single method of measuring the q/m ratio be consistently used, as the values of q/m may vary from one method to another. Toner diameter may be determined using a commercially available device such as the Coulter Multisizer.

It is desirable that the charge-to-mass ratios and the diameters of the separate color component toners be reasonably close. More specifically, it is preferable that the lowest charging toner have a charge-to-mass ratio that is not less than 80% of the highest charged toner and more preferably not less than 90% of the highest charged toner. In these instances, the charge of the toner refers to the charge-to-mass ratio of the toner when mixed with the same carrier that is used in the custom accent color developer at a concentration that is the same as the nominal concentration of the total of all colorants in the custom accent color developer. It is also preferable that the difference in the volume-weighted diameter between the largest and smallest toner particles be less than 1 μm. In order to further avoid tent polling during transfer, it is also preferable that the fineness index of each toner be less than 1.3. While this can be achieved using toners that have been prepared by compounding and drying, followed by classification, it is preferable to prepare dry inks for use in custom accent color developers by chemical means such as evaporative limited coalescence.

In the practice of this invention, a developer of the correct color is made by mixing appropriate amounts of two or more component toners. The color of these component toners may include cyan, magenta, yellow subtractive primary colors that are used in process color imaging. The component toners may also include colored toners from a larger colorant set. For example, the colorant set might include toners having colors that are outside the color space that is achievable with the subtractive primary process colors. For example, colors such as bright orange or white may be included within the color set.

EXAMPLE

The diameters of Magenta and Yellow toners, prepared by an evaporative limited coalescence process, were determined to be 6.24 μm and 6.39 μm respectively. The fineness indices of these Magenta and Yellow toners were determined to be 1.28 and 1.22 respectively. Samples of the Magenta and Yellow toners were each surface treated with varying blends of silicas TG810G (surface modification: hexamethyldisalazane), manufactured by Cabot Corp., and R972 (surface modification: dichlorodimethylsilane), manufactured by Degussa AG. Developers were prepared, with a common ferrite-based carrier, with each of the surface treated samples, at a toner concentration of 6%. FIG. 1 is a plot of q/m of each sample versus the percent of TG810G silica in the surface treatment of the sample. The circle symbols represent the data for Magenta toner and the square symbols represent the data for Yellow toner. The dashed lines are least square fits to the data for each color toner. A custom color toner was made by mixing equal amounts of the Magenta toner, surface treated with a 25% TG810G/75% R972 silica blend, and the Yellow toner, surface treated with 100% TG810G/0% R972 silica blend. The custom color blend was mixed with a ferrite-based carrier at a toner concentration of 6%. When combined alone with the same carrier, the q/m of the Magenta toner surface treated with 25% TG810G/75% R972 was −55.6 μC/gm, and the Yellow toner surface treated with 100% TG810G/0% R972 was −48.3 μC/gm.

Figure 2:
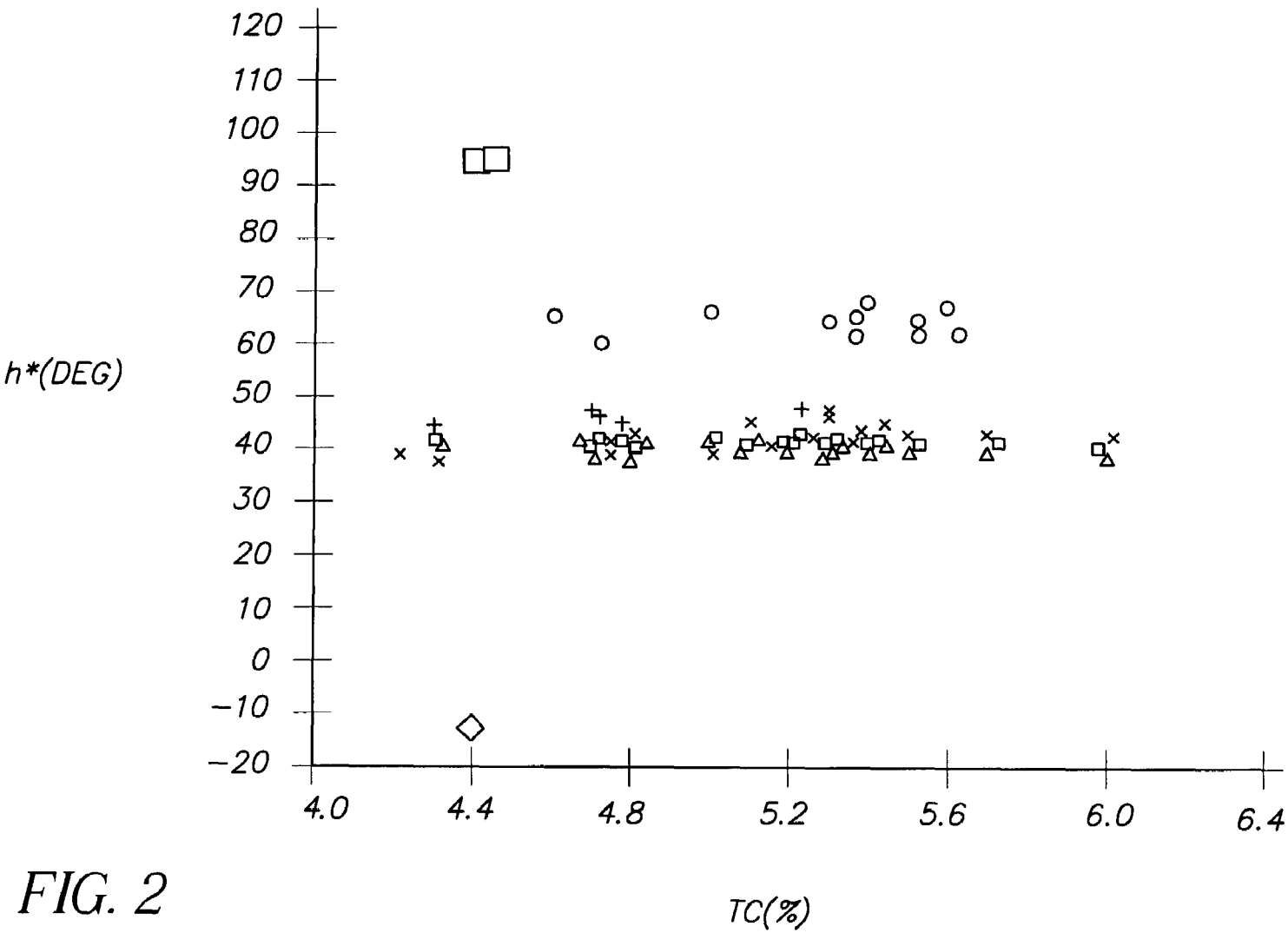
FIG. 2 is a plot of the hue angle of several samples of a custom color toner prepared by the method of this invention with the two component color toners of FIG. 1.

The custom color developer was loaded into an appropriate electrophotographic two component development station. An imaging member was negatively charged and exposed through a transparent continuous neutral density step tablet, thereby creating an electrostatic latent image. The latent image was developed into a visible image by bringing the imaging member into proximity with the development station containing the custom color developer. This image was then transferred to an electrically biased (+800 volts) compliant intermediate member and subsequently transferred to paper by reversing the bias on the compliant intermediate member to drive the dry ink particles towards the paper. Microscopic examination of the unfused image on the paper showed that approximately equal amounts of the yellow and magenta toner particles developed and transferred, resulting in an orangish color image of varying density on the paper. The image was subsequently thermally fused. Imaging with the custom color developer was continued in this way without replenishing with the custom color toner, until the toner concentration had dropped to approximately 4%. Coloremetric measurements were made on all of the images with a Spectrolino manufactured by Gretagmacbeth, and the hue angle, h* was computed. FIG. 2 is a plot of hue angle versus the toner concentration of the custom color developer. Both subjective evaluation of the color of the images and the plot of hue angle data in FIG. 2 indicate that the ratio of the Magenta toner and Yellow toner in the custom color blend remained constant with use of the developer.

The invention has been described in detail with particular reference to certain preferred embodiments thereof, but it will be understood that variations and modifications can be effected within the spirit and scope of the invention.

What is claimed is:

1. A method of producing a custom color toner for use in a two-component developer, said method comprising:

a. selecting a plurality of component color toners to be blended together to create said custom color toner, said custom color toner to be mixed with a particulate carrier to form a developer;

b. surface treating at least one of said plurality of component color toners with a blended mixture of two or more types of silica particles, each type of said silica particles having a different functional group appended thereto, so that, when mixed with said particulate carrier, each of said plurality of component color toners tribocharges to a same predetermined charge-to-mass ratio; and c. mixing said plurality of component toners in a predetermined ratio to produce said custom color toner.

2. The method according to claim 1, wherein said functional group is a silane based derivative.

3. The method according to claim 2, wherein said functional group is selected from the group consisting of dimethyl-dichloro-silane, hexamethyl-disalazane, silicone oil, trimethoxy-octyl-silane, octamethyl-cyclo-tetra-siloxane, hexadecyl-silane, triethoxy-proply-amino-silane, and methyacryl-silane.

4. The method according to claim 1, wherein said particulate toner has a volume weighted average diameter in the range from about 3.0 μm to about 6.0 μm.

5. The method according to claim 4, wherein said functional group is a silane based derivative.

6. The method according to claim 5, wherein said functional group is selected from the group consisting of dimethyl-dichloro-silane, hexamethyl-disalazane, silicone oil, trimethoxy-octyl-silane, octamethyl-cyclo-tetra-siloxane, hexadecyl-silane, triethoxy-proply-amino-silane, and methyacryl-silane.

7. The method according to claim 4, wherein said particulate toner has a fineness index in the range from about 1.0 to about 1.3.

8. The method according to claim 7, wherein said functional group is a silane based derivative.

9. The method according to claim 8, wherein said functional group is selected from the group consisting of dimethyl-dichloro-silane, hexamethyl-disalazane, silicone oil, trimethoxy-octyl-silane, octamethyl-cyclo-tetra-siloxane, hexadecyl-silane, triethoxy-proply-amino-silane, and methyacryl-silane.

10. A method of producing a custom color toner for use in a two-component electrophotographic developer, said method comprising:

a. selecting a plurality of component color toners to be blended together to create said custom color toner, said custom color toner to be mixed with a particulate carrier to form a developer;

b. surface treating each of said plurality of component color toners with a blended mixture of two or more types of silica particles, each type of said silica particles having a different functional group appended thereto, so that, when mixed with said particulate carrier, each of said plurality of component color toners tribocharges to a charge-to-mass ratio within a 90% range; and c. mixing said plurality of component toners in a predetermined ratio to produce said custom color toner.

11. The method according to claim 10, wherein said functional group is a silane based derivative.

12. The method according to claim 11, wherein said functional group is selected from the group consisting of dimethyl-dichloro-silane, hexamethyl-disalazane, silicone oil, trimethoxy-octyl-silane, octamethyl-cyclo-tetra-siloxane, hexadecyl-silane, triethoxy-proply-amino-silane, and methyacryl-silane.

13. The method according to claim 10, wherein said particulate toner has a volume weighted average diameter in the range from about 3.0 μm to about 6.0 μm.

14. The method according to claim 13, wherein said functional group is a silane based derivative.

15. The method according to claim 14, wherein said functional group is selected from the group consisting of dimethyl-dichloro-silane, hexamethyl-disalazane, silicone oil, trimethoxy-octyl-silane, octamethyl-cyclo-tetra-siloxane, hexadecyl-silane, triethoxy-proply-amino-silane, and methyacryl-silane.

16. The method according to claim 13, wherein said particulate toner has a fineness index in the range from about 1.0 to about 1.3.

17. The method according to claim 16, wherein said functional group is a silane based derivative.

18. The method according to claim 17, wherein said functional group is selected from the group consisting of dimethyl-dichloro-silane, hexamethyl-disalazane, silicone oil, trimethoxy-octyl-silane, octamethyl-cyclo-tetra-siloxane, hexadecyl-silane, triethoxy-proply-amino-silane, and methyacryl-silane.

19. A method of producing a custom color toner for use in a two-component electrophotographic developer, said method comprising:

a. selecting a plurality of component color toners to be blended together to create said custom color toner, said custom color toner to be mixed with a particulate carrier to form a developer;

b. surface treating each of said plurality of component color toners with a blended mixture of two or more types of silica particles, each type of said silica particles having a different functional group appended thereto, so that, when mixed with said particulate carrier, each of said plurality of component color toners tribocharges to a charge-to-mass ratio within a 80% range; and c. mixing said plurality of component toners in a predetermined ratio to produce said custom color toner.

20. The method according to claim 19, wherein said functional group is a silane based derivative.

21. The method according to claim 20, wherein said functional group is selected from the group consisting of dimethyl-dichloro-silane, hexamethyl-disalazane, silicone oil, trimethoxy-octyl-silane, octamethyl-cyclo-tetra-siloxane, hexadecyl-silane, triethoxy-proply-amino-silane, and methyacryl-silane.

22. The method according to claim 19, wherein said particulate toner has a volume weighted average diameter in the range from about 3.0 μm to about 6.0 μm.

23. The method according to claim 22, wherein said functional group is a silane based derivative.

24. The method according to claim 23, wherein said functional group is selected from the group consisting of dimethyl-dichloro-silane, hexamethyl-disalazane, silicone oil, trimethoxy-octyl-silane, octamethyl-cyclo-tetra-siloxane, hexadecyl-silane, triethoxy-proply-amino-silane, and methyacryl-silane.

25. The method according to claim 22, wherein said particulate toner has a fineness index in the range from about 1.0 to about 1.3.

26. The method according to claim 25, wherein said functional group is a silane based derivative.

27. The method according to claim 26, wherein said functional group is selected from the group consisting of dimethyl-dichloro-silane, hexamethyl-disalazane, silicone oil, trimethoxy-octyl-silane, octamethyl-cyclo-tetra-siloxane, hexadecyl-silane, triethoxy-proply-amino-silane, and methyacryl-silane.

* * * * *